United States Patent [19]

Hastings

[11] Patent Number: 4,946,118

[45] Date of Patent: Aug. 7, 1990

[54] TRASH BAG RETAINER

[76] Inventor: Stanley V. Hastings, 2029 Lakeside Apt. #5, Moses Lake, Wash. 98837

[21] Appl. No.: 330,168

[22] Filed: Mar. 29, 1989

[51] Int. Cl.[5] ..... A63B 55/04

[52] U.S. Cl. ..... 248/97; 220/404; 220/908; 248/101

[58] Field of Search ..... 248/97, 101, 99, 95, 248/156, 551, 552; 292/256.6, 256.3, 230, 238; 220/335, 404, 401, 1 T

[56] References Cited

U.S. PATENT DOCUMENTS

| | | | |
|---|---|---|---|
| 1,664,658 | 4/1928 | Blazer | 248/101 X |
| 2,442,377 | 6/1948 | Regele | 248/101 |
| 3,451,582 | 6/1969 | Morgan | 220/401 X |
| 3,468,505 | 9/1969 | Reilly | 248/101 |
| 3,773,286 | 11/1973 | Govoni et al. | 248/156 X |
| 3,866,872 | 2/1975 | Burgess | 248/97 |
| 3,930,594 | 1/1976 | Jungmann | 220/335 |
| 4,069,993 | 1/1978 | Shanks | 248/97 |
| 4,157,801 | 6/1979 | Elmer | 248/97 |
| 4,413,800 | 11/1983 | Kelson | 248/99 |
| 4,630,752 | 12/1986 | DeMars | 220/404 |
| 4,690,357 | 9/1987 | Webster | 248/99 |
| 4,702,445 | 10/1987 | Ivory | 248/97 X |
| 4,733,840 | 3/1988 | D'Amore | 248/551 X |
| 4,753,367 | 6/1988 | Miller et al. | 220/404 |
| 4,759,518 | 7/1988 | Yardas | 248/97 |

FOREIGN PATENT DOCUMENTS

| | | | |
|---|---|---|---|
| 112715 | 1/1969 | Fed. Rep. of Germany | 248/97 |
| 174106 | 1/1961 | Sweden | 248/101 |

*Primary Examiner*—David L. Talbott
*Assistant Examiner*—Daniel Hulseberg
*Attorney, Agent, or Firm*—Jerry T. Kearns

[57] ABSTRACT

A trash bag retainer includes a generally cylindrical wire frame having fixed bottom and upper support rings connected by vertical support members. A hinged clamping ring overlies the fixed upper support ring for frictionally clamping a plastic trash bag within the wire frame. A counter weight has an apertured lobe mounted for pivotal movement on the upper support ring and has an upper end portion provided with a recess which receives an edge portion of the clamping ring for retaining the clamping ring in an open position during installation of a trash bag. A ground insertion spike is mounted on the bottom support ring for movement between operative and retracted positions. In the operative position, the ground inserted spike retains the wire frame at a desired location. A plurality of rings are provided on the wire frame for securing the frame to a stationary object and for retaining the clamping ring in a closed position. In a first embodiment, the clamping ring is a circular ring formed from a cylindrical rod and has a diameter slightly greater than the upper support ring to frictionally clamp a trash bag between the clamping ring and the support ring. In a second embodiment, the clamping ring is a circular ring having a flat upper surface and a perpendicular cylindrical side wall having an inner diameter slightly greater than the outer diameter of the stationary support ring to frictionally clamp a trash bag between the clamping ring and the support ring.

3 Claims, 3 Drawing Sheets

TRASH BAG RETAINER

BACKGROUND OF THE INVENTION

1. Field of the Invention

The present invention relates to trash bag retainers, and more particularly pertains to an improved trash bag retainer for use with flexible plastic trash bags. A large amount of trash is generated at outdoor events such as sporting events, parades, picnics, backyard barbecues, yard clean-up projects, etc. In order to alleviate the expense of providing large fixed trash receptacles for such temporary usage, the present invention provides an inexpensive wire frame retainer to support a conventional trash bag.

2. Description of the Prior Art

Various types of trash bag retainers are known in the prior art. A typical example of such a trash bag retainer is to be found in U.S. Pat. No. 3,866,872, which issued to L. Burgess on Feb. 18, 1975. This patent discloses a bag holder formed from molded or extruded plastic components which are assembled by slip fit arrangements without requiring any fasteners. U.S. Pat. No. 4,069,993, which issued to D. Shanks on Jan. 24, 1978, discloses a trash bag retainer for gripping a marginal portion of the mouth of a trash bag which includes a substantially vertical upright peg secured at a lower end to a support member. A resilient locking ring having an inside diameter less than the diameter of the peg is adapted to be moved downwardly over the peg with the marginal portion of the bag being spread over the peg to hold the bag upon the peg. U.S. Pat. No. 4,157,801, which issued to F. Elmer on June 12, 1979, discloses a trash bag retainer formed from upper and lower support members connected by generally vertical struts. The device may be provided in an assembled kit form of primarily straight tube sections suitable for assembly when required. U.S. Pat. No. 4,413,800, which issued to A. Kelson on Nov. 8, 1983, discloses a trash bag retainer having a rigid hoop and rod base for supporting and holding the entrance of a trash bag open to receive debris. The base includes a pair of U-shaped leg members arranged normal to each other and having their free ends detachably secured to the hoop by snap lock fasteners. U.S. Pat. No. 4,690,357, which issued to J. Webster on Sep. 1, 1987, discloses a trash bag retainer formed from a free standing frame and lid assembly for supporting plastic trash bags during filling. The stand consists of a metal frame having a top rectangular section over which the opening of the plastic bag may be stretched. A similar bottom rectangular section rests on the floor and two vertical legs rigidly connected the preceding sections by continuing wire members. The lid is hinged to one side of the top rectangular section of the frame by a circular clip attached to the lid.

While the above mentioned devices are directed to trash bag retainers, none of these devices disclose a trash bag retainer having a generally cylindrical wire frame having fixed bottom and upper support rings connected by vertical support members and having a hinged clamping ring overlying the fixed upper support ring and including a counter weight for retaining the clamping ring in an open position during bag installation. Additionally, none of the aforementioned devices disclose the provision of a ground insertion spike mounted for movement between retracted and extended positions to maintain a wire frame trash bag retainer secured at a selected location. Inasmuch as the art is relatively crowded with respect to these various types of trash bag retainers, it can be appreciated that there is a continuing need for and interest in improvements to such trash bag retainers, and in this respect, the present invention addresses this need and interest.

SUMMARY OF THE INVENTION

In view of the foregoing disadvantages inherent in the known types of trash bag retainers now present in the prior art, the present invention provides an improved trash bag retainer. As such, the general purpose of the present invention, which will be described subsequently in greater detail, is to provide a new and improved trash bag retainer which has all the advantages of the prior art trash bag retainers and none of the disadvantages.

To attain this, representative embodiments of the concepts of the present invention are illustrated in the drawings and make use of a trash bag retainer which includes a generally cylindrical wire frame having fixed bottom and upper support rings connected by vertical support members. A hinged clamping ring overlies the fixed upper support ring for frictionally clamping a plastic trash bag within the wire frame. A counter weight has an apertured lobe mounted for pivotal movement on the upper support ring and has an upper end portion provided with a recess which receives an edge portion of the clamping ring for retaining the clamping ring in an open position during installation of a trash bag. A ground insertion spike is mounted on the bottom support ring for movement between operative and retracted positions. In the operative position, the ground inserted spike retains the wire frame at a desired location. A plurality of rings are provided on the wire frame for securing the frame to a stationary object and for retaining the clamping ring in a closed position. In a first embodiment, the clamping ring is a circular ring formed from a cylindrical rod and has a diameter slightly greater than the upper support ring to frictionally clamp a trash bag between the clamping ring and the support ring. In a second embodiment, the clamping ring is a circular ring having a flat upper surface and a perpendicular cylindrical side wall having an inner diameter slightly greater than the outer diameter of the stationary support ring to frictionally clamp a trash bag between the clamping ring and the support ring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash bag retainer which has all the advantages of the prior art trash bag retainers and none of the disadvantages.

It is another object of the present invention to provide a new and improved trash bag retainer which may be easily and efficiently manufactured and marketed.

It is a further object of the present invention to provide a new and improved trash bag retainer which is of a durable and reliable construction.

An even further object of the present invention is to provide a new and improved trash bag retainer which is susceptible of a low cost of manufacture with regard to both materials and labor, and which accordingly is then susceptible of low prices of sale to the consuming public, thereby making such trash bag retainers economically available to the buying public.

Still yet another object of the present invention is to provide a new and improved trash bag retainer which provides in the apparatuses and methods of the prior art some of the advantages thereof, while simultaneously overcoming some of the disadvantages normally associated therewith.

Still another object of the present invention is to provide a new and improved trash bag retainer for retaining a plastic trash bag in an open condition for collecting trash at various outdoor events.

Yet another object of the present invention is to provide a new and improved trash bag retainer having a counter weight mechanism for retaining a clamping ring in an open position during installation of a trash bag.

Even still another object of the present invention is to provide a new and improved trash bag retainer including a ground insertion spike mounted for movement between operative and retracted positions to selectively retain a wire frame trash bag retainer at a desired location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
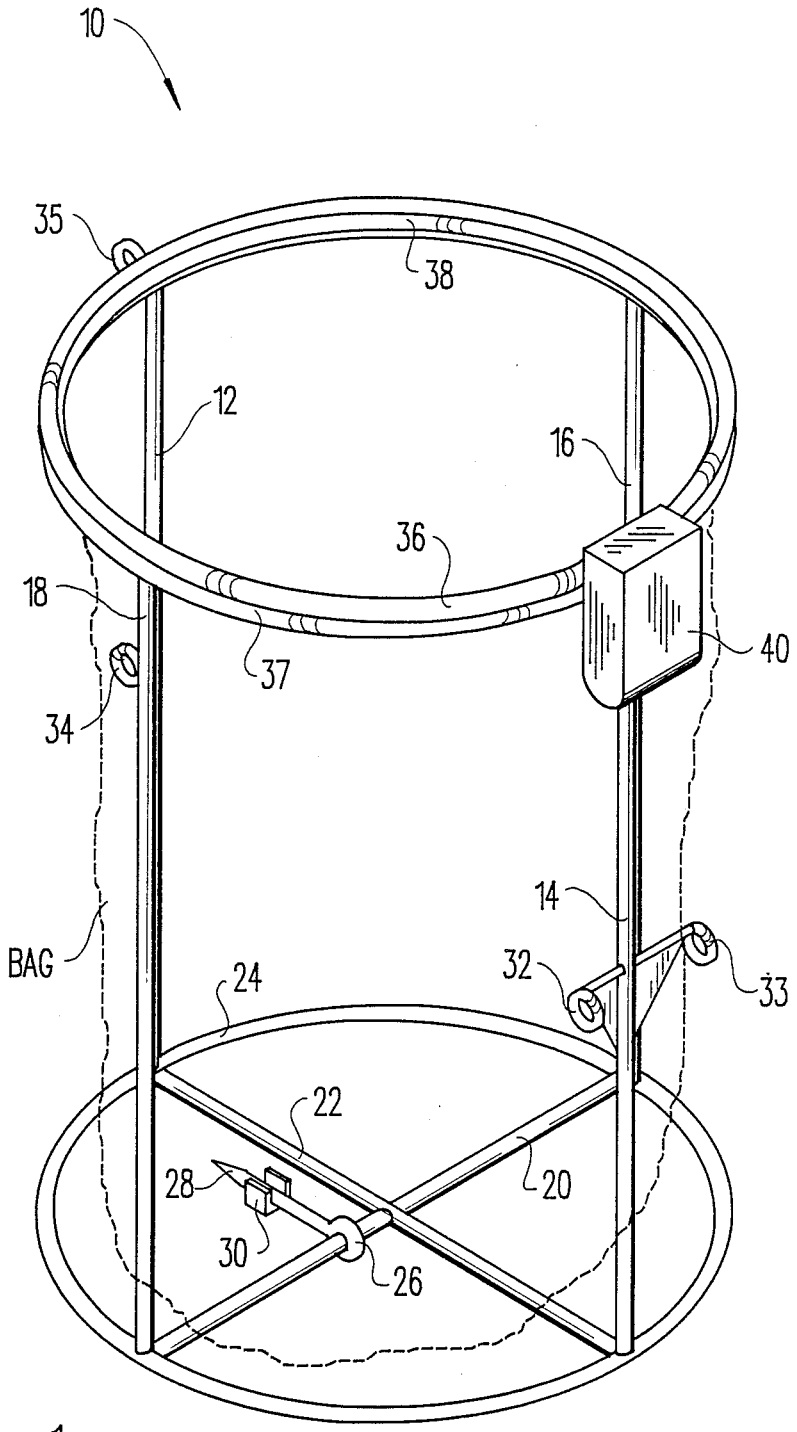
FIG. 1 is a perspective view of the trash bag retainer according to the first embodiment of the present invention.

With reference now to the drawings, and in particular to FIG. 1 thereof, a new and improved trash bag retainer embodying the principles and concepts of the present invention and generally designated by the reference numeral 10 will be described.

More specifically, it will be noted that the first embodiment 10 of the invention includes a generally cylindrical wire frame having a fixed bottom support ring 24 and upper support ring 38 connected by a plurality of vertical support members 12, 14, 16 and 18. A stationary top support ring 37 is secored to the vertical support members 12, 14, 16, and 18 by welding, or the like, with an upper support ring 38 fixed atop the stationary top support ring 37. A hinged clamping ring 36 overlies the fixed upper support ring 38 and a counter weight 40 is arranged to retain the clamping ring 36 in an open position during installation of a trash bag. A pair of perpendicular cross brace struts 20 and 22 provide reinforcement to the bottom support ring 24. A ground insertion spike has a circular ring 26 formed at one end and is pivotally received on the brace 20 to mount the spike for movement between operative and the illustrated retracted position. The pointed tip 28 of the spike is adapted for insertion into the ground to retain the wire frame at a selective location. A clip 30 may be formed from spring steel or a resilient plastic and includes an arcuate recess dimensioned to frictionally retain the spike when in a retracted or storage position. A pair of rings 34 and 35 are secured on the vertical support 12 and on the clamping ring 36 to retain the clamping ring in a locked position by the use of a conventional chain fastener. A ring assembly 32 is provided on the vertical support member 14 for securing the wire frame to a stationary object such as a utility pole, a tree, etc. In use, a conventional flexible plastic trash bag is supported in an open position within the wire frame for collecting trash and debris.

Figure 2:
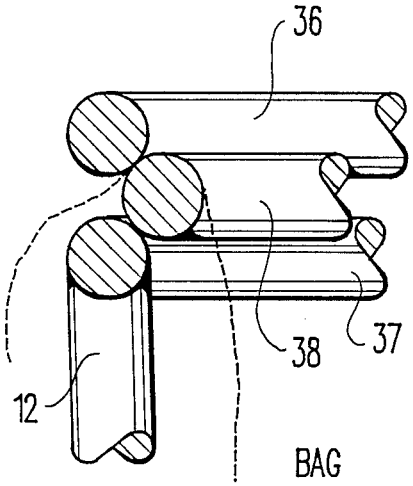
FIG. 2 is an enlarged detail view, partially in cross section, illustrating the clamping arrangement for securing the mouth of a trash an open position.

FIG. 2 is an enlarged detail view, partially in cross section, illustrating the construction of the bag clamping assembly. A first stationary ring 37 extends in a horizontal plane between the vertical support members, one of which is illustrated at 12. A second upper stationary support ring 38 has a slightly smaller diameter and is secured to the ring 37, for example by welding. The hinged clamping ring 36 has an inner diameter slightly greater than the outer diameter of the ring 38 and is dimensioned to frictionally clamp the mouth of a flexible bag between the clamping ring 36 and the upper support ring 38.

Figure 3:
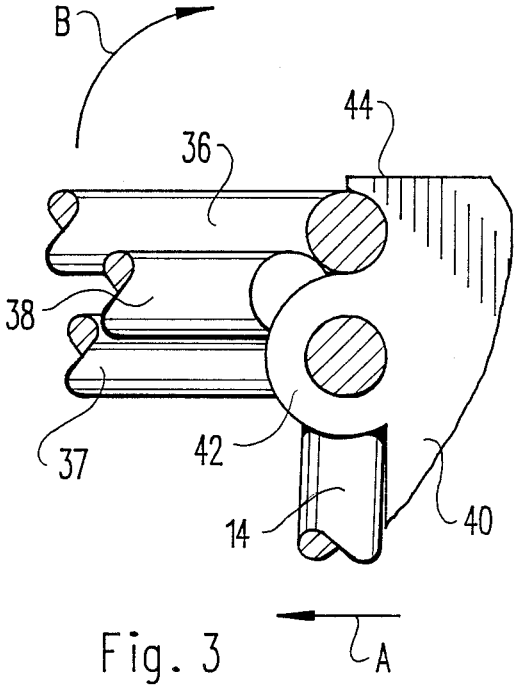
FIG. 3 is an enlarged detail view, partially in cross section, illustrating the counter weight mechanism utilized to maintain the clamping, ring in an open position during installation of a trash bag.

FIG. 3 is an enlarged detail view illustrating the construction of the counter weight mechanism 40. The counter weight 40 has an apertured lobe portion 42 which is mounted for reciprocal pivotal movement on the stationary ring 37. The upper end portion of the counter weight 40 has a recess which receives the pivotal clamping ring 36. When the clamping ring 36 is pivoted to an open position as indicated by arrow B, engagement of the clamping ring 36 with the top end portion 44 of the counter weight 40 will cause the lower end of the counter weight to move inwardly into the open body portion of the wire frame as indicated by the arrow A. The force exerted by the counter weight on the clamping ring 36 will retain the ring 36 in an open position and free the hands of a user to install a new trash bag therein.

Figure 4:
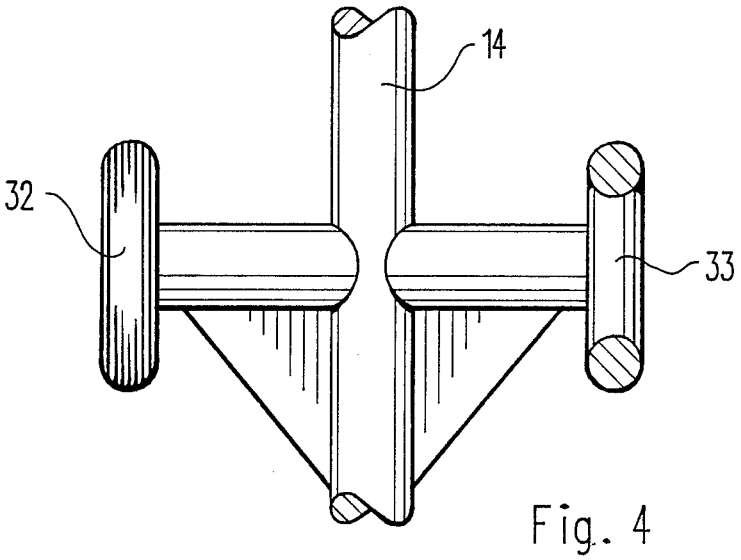
FIG. 4 is an enlarged detail view, illustrating a pair of ring members utilized to secure the trash bag retainer to a stationary object.

FIG. 4 is an enlarged detail view, illustrating a pair of rings 32 and 33 secured to the vertical support member 14 to enable the wire frame to be chained to a stationary object to prevent theft of the bag retainer.

Figure 5:
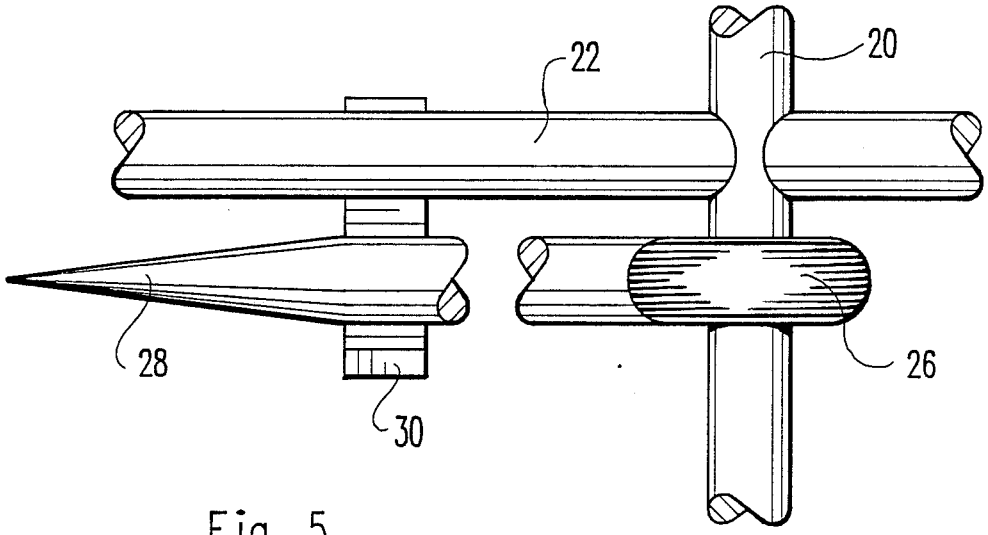
FIG. 5 is an enlarged detail view, illustrating a retractable ground insertion spike utilized to retain the trash bag retainer at a desired location.

FIG. 5 is an enlarged detail view, illustrating the ground insertion spike member 28 having a ringed end portion 26 received for pivotal movement on the brace strut 20. A resilient clip 30 includes an arcuate recess for snap type engagement with the body of the spike 28 to retain the spike 28 in a retracted position when not in use.

Figure 6:
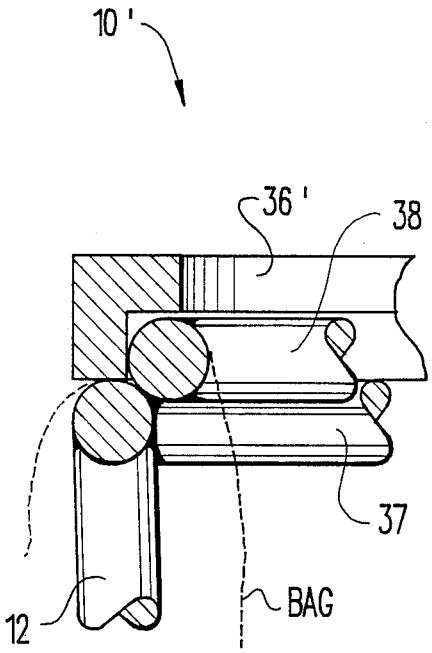
FIG. 6 is an enlarged detail view, partially in cross section, illustrating an alternative clamping ring construction according to a second embodiment of the present invention.

FIG. 6 is an enlarged detail view, partially in cross section, which illustrates a second embodiment 10' of the present invention which utilizes a clamping ring 36' having a flat circular top surface perpendicularly connected to a cylindrical side wall having an inner diameter slightly greater than the outer diameter of the stationary upper support ring 38, to frictionally retain the mouth of a bag in an open position.

Figure 7:
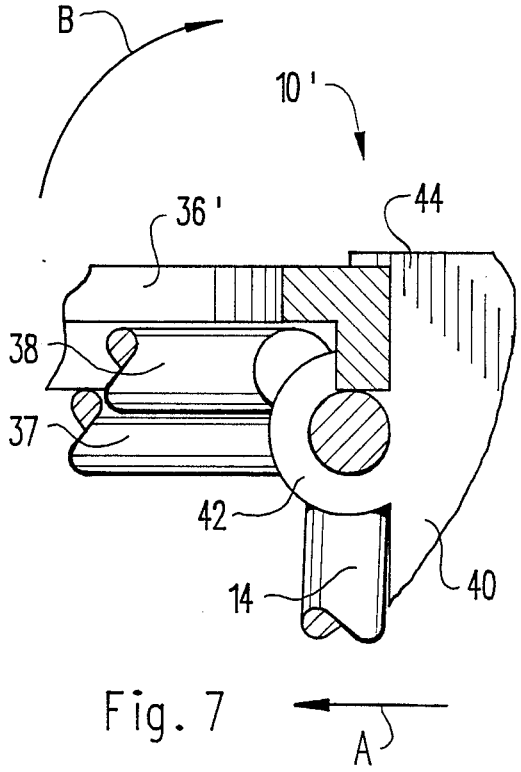
FIG. 7 is an enlarged detail view, partially in cross section, illustrating the counter weight construction utilized with the modified clamping ring according to the second embodiment of the present invention.

As illustrated in FIG. 7, the upper end portion 44 of the counter weight 40 has been slightly modified to form an abutment for the cylindrical side wall of the clamping ring 36', but operates in the manner described previously with respect to FIG. 3. The various components of the present invention are preferably formed from a corrosion resistant steel which may be zinc plated to provide a long service life. The open wire framed construction allows for inexpensive manufacture and also provides a light weight receptacle allowing convenient transportation. Alternatively, the trash bag retainer of the present invention may be formed from a molded plastic material in a wide variety of colors for indoor use. It should be noted that the trash bag retainer of the present invention may be formed in a wide variety of different sizes for use with various standard sized conventional trash bags.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A trash bag retainer, comprising:

a generally cylindrical wire frame having a bottom support ring and top support ring connected by vertical support members and a fixed upper support ring secored to said top support ring;

a pair of intersecting perpendicular brace struts secured diametrically across said bottom support ring;

a hinged clamping ring overlying said fixed upper support ring and pivotally connected to said top support ring by a hinge means;

said hinge means being a counter weight having an apertured lobe mounted for pivotal movement on said top support ring, said counter weight having an upper end portion provided with a recess receiving a portion of said clamping ring in an open position during installation of a trash bag;

a ground insertion spike having a circular ring at one end received around one of said brace struts, said spike mounted for pivotal movement between operative and retracted positions on said bottom support ring for retaining said bag retainer in a selective location, and for lateral sliding movement along said brace strut;

a clip mounted on the other of said brace struts for securing said spike in a retracted position;

a first ring means on said frame for securing said frame to a stationary object;

and second ring means on said frame for securing said clamping ring in a closed position.

2. The trash bag retainer of claim 1, wherein said clamping ring comprises a circular ring formed from a cylindrical rod and having a diameter slightly greater than said upper support ring to frictionally clamp a trash bag between said clamping ring and said upper support ring.

3. The trash bag retainer of claim 1, wherein said clamping ring comprises a circular ring having a flat upper surface and a perpendicular cylindrical side wall having an inner diameter slightly greater than the outer diameter of said upper support ring to frictionally clamp a trash bag between said clamping ring and said upper support ring.

* * * * *